US007828416B2

(12) United States Patent
Yamada

(10) Patent No.: US 7,828,416 B2
(45) Date of Patent: Nov. 9, 2010

(54) INKJET PRINTER AND MANUFACTURING METHOD FOR SAME

(75) Inventor: Takahiro Yamada, Toyoake (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 932 days.

(21) Appl. No.: 11/708,844

(22) Filed: Feb. 21, 2007

(65) Prior Publication Data

US 2007/0195124 A1 Aug. 23, 2007

(30) Foreign Application Priority Data

Feb. 21, 2006 (JP) ..... 2006-044167

(51) Int. Cl.
*B41J 2/14* (2006.01)
*B41J 2/16* (2006.01)

(52) U.S. Cl. ..... 347/50; 347/58

(58) Field of Classification Search ..... 347/40, 347/42, 50, 58–59, 64–65, 71
See application file for complete search history.

(56) References Cited

U.S. PATENT DOCUMENTS 6,729,717 B2 5/2004 Ito et al.
7,063,405 B2 6/2006 Ito et al.
7,252,369 B2 * 8/2007 Nakamura et al. ..... 347/65

FOREIGN PATENT DOCUMENTS

JP 2002-144590 5/2002

* cited by examiner

*Primary Examiner*—Thinh H Nguyen
(74) *Attorney, Agent, or Firm*—Frommer Lawrence & Haug LLP

(57) ABSTRACT

An inkjet printer is provided with: a recording head having an actuator for generating energy in order to jet ink and a wiring member which allows a drive signal to be inputted; and a head holder having a bottom wall for supporting the recording head. The recording head is placed so that the wiring member faces a lower surface of the bottom wall, and after that, a blocking member for preventing an adhesive from making contact with the wiring member is moved so as to make contact with end portions on both sides of the recording head. In this state, a space between the end portions on both sides of the recording head and the lower surface of the bottom wall is filled in with an adhesive, and thus, the recording head and the head holder are bonded together.

15 Claims, 6 Drawing Sheets

INKJET PRINTER AND MANUFACTURING METHOD FOR SAME

CROSS-REFERENCE TO RELATED APPLICATIONS

This Nonprovisional application claims priority under 35 U.S.C. §119(a) on Patent Application No. 2006-044167 filed in Japan on Feb. 21, 2006, the entire contents of which are hereby incorporated by reference.

BACKGROUND

The present invention relates to an inkjet printer where a recording head and a head holder are bonded together and a manufacturing method for the same. In particular, the invention relates to an inkjet printer having a structure for preventing the occurrence of electrical malfunctioning, such as defective insulation in a recording head due to an adhesive, where the recording head and a head holder can be bonded together while preventing contact between a wiring member which is connected to the recording head and an adhesive as well as a manufacturing method for the same.

As a conventional structure of an inkjet printer head, a structure is well-known where a recording head is placed in such a manner that the side to which a wiring member for allowing a drive signal to be inputted to an actuator of the recording head is connected faces a lower surface of the bottom wall of the head holder, and a space between end portions on both sides of the recording head which are perpendicular to the direction in which the recording head and the head holder face each other and the bottom wall of the head holder is filled in with an adhesive so that the recording head and the head holder are bonded together.

Concretely, a recording head where a nozzle plate on which a plurality of nozzles for jetting ink are provided, a cavity plate with a pressure chamber containing ink, an actuator for generating energy in order to jet ink and a wiring member for allowing a drive signal to be inputted to the actuator are layered in this order is placed in such a manner that the wiring member faces the lower surface of the bottom wall of the head holder. In addition, the space between the end portions on both sides of the recording head which are located in the width direction of the wiring member and the head holder is filled in with an adhesive which is applied through openings provided so as to penetrate through the bottom wall of the head holder, and thus, the recording head and the head holder are bonded together (for example, Japanese Patent Application Laid-Open No. 2002-144590).

SUMMARY

In this configuration, however, electrical malfunctioning, such as defective insulation due to contact between the adhesive and the wiring member, may sometimes occur. In particular, in the case where an ultraviolet ray curing adhesive is used for bonding, an adhesive which deviates to the side from the area directly beneath the openings so as to come into a space between the recording head and the head holder and make contact with the wiring member stays uncured because ultraviolet rays for curing do not reach it, and electrical malfunctioning, such as defective insulation due to migration, is caused.

An object of the present invention is to provide an inkjet printer where electrical malfunctioning due to an adhesive in the recording head can be prevented as well as a manufacturing method for the same.

The inkjet printer according to the first aspect is provided with: a recording head with an actuator for generating energy in order to jet ink, where a wiring member for allowing a drive signal to be inputted to the actuator is connected to an upper surface of the actuator; and a head holder having a bottom wall for supporting the recording head, where the recording head and the head holder are bonded together with an adhesive with which a space between end portions on both sides of the recording head which are perpendicular to the direction in which the recording head is placed so that the wiring member faces a lower surface of the bottom wall and the lower surface of the bottom wall is filled in, and in the inkjet printer, a blocking member for preventing the adhesive from making contact with the wiring member is inserted between the end portions on both sides of the recording head and the wiring member on the upper surface of the actuator as a member different from the recording head and the head holder.

The inkjet printer according to the first aspect has a structure where the blocking member is inserted between the end portions on both sides of the recording head and the wiring member on the upper surface of the actuator, and thereby, the recording head and the head holder are bonded together in a state where the adhesive does not make contact with the wiring member. In addition, the blocking member is a member different from the recording head and the head holder, and therefore, the blocking member can be placed in a location where no adhesive makes contact with the wiring member after the relative position of the recording head and the head holder is corrected on a jig, and thus, a structure where precision in the relative positioning of the recording head and the head holder is maintained can be provided. The adhesive for bonding the recording head and the head holder together while precisely maintaining the relative positioning of the two does not make contact with the wiring member of the recording head, and therefore, electrical malfunctioning, such as defective insulation due to an adhesive, can be prevented from occurring as a result of migration.

A manufacturing method for an inkjet printer according to the second aspect is a manufacturing method for an inkjet printer, according to which a recording head having an actuator for generating energy in order to jet ink and a wiring member for allowing a drive signal to be inputted to the actuator which is connected to an upper surface of the actuator and a head holder having a bottom wall for supporting the recording head are bonded together and secured to each other by filling a space between end portions on both sides of the recording head which are perpendicular to the direction in which the recording head and a lower surface of the bottom wall face each other and the lower surface of the bottom wall with an adhesive, wherein: a blocking member having a pair of side wall portions corresponding to regions between the end portions on both sides of the recording head and the wiring member is held against the bottom wall of the head holder in such a manner that the blocking member can be moved in the direction in which the recording head and the lower surface of the bottom wall face each other; the head holder holding the blocking member and the recording head are arranged in such a state that the wiring member of the recording head faces the lower surface of the bottom wall; the blocking member is moved in the direction in which the pair of side wall portions make contact with the recording head in such a state that the recording head faces the lower surface of the bottom wall; and a space in the pair of side wall portions on the side opposite to the wiring member and between the end portions on both sides of the recording head and the lower surface of the bottom wall is filled in with the adhesive in such a state that the pair of side wall portions and the recording head make contact with each other, so that the head holder and the recording head are bonded together and secured to each other.

In accordance with the manufacturing method for an inkjet printer according to the second aspect, the relative position of the recording head and the head holder is corrected on a jig, and then, the blocking member is moved to make contact with the recording head, and the adhesive can be applied in a state where no adhesive makes contact with the wiring member. That is to say, the recording head and the head holder can be bonded together without making an adhesive make contact with the wiring member while maintaining the precision in the relative positioning of the two. The blocking member is moved in the direction toward the recording head in a state where the relative position of the recording head and the head holder is corrected on a jig, and the adhesive is applied without making contact with the wiring member, and thus, the recording head and the head holder can be bonded together. Therefore, electrical malfunctioning, such as defective insulation due to an adhesive, can be prevented from occurring and assembly can be easily achieved with high precision in the location of the recording head relative to the head holder.

The above and further objects and features of the invention will more fully be apparent from the following detailed description with accompanying drawings.

DETAILED DESCRIPTION OF THE EXEMPLARY EMBODIMENTS

In the following, the present invention is described in detail in reference to the drawings, which show the embodiments thereof Here, the following embodiments are mere examples, and the embodiments can, of course, be modified in an appropriate manner, within such a scope as not to change the gist of the present invention.

Figure 1:
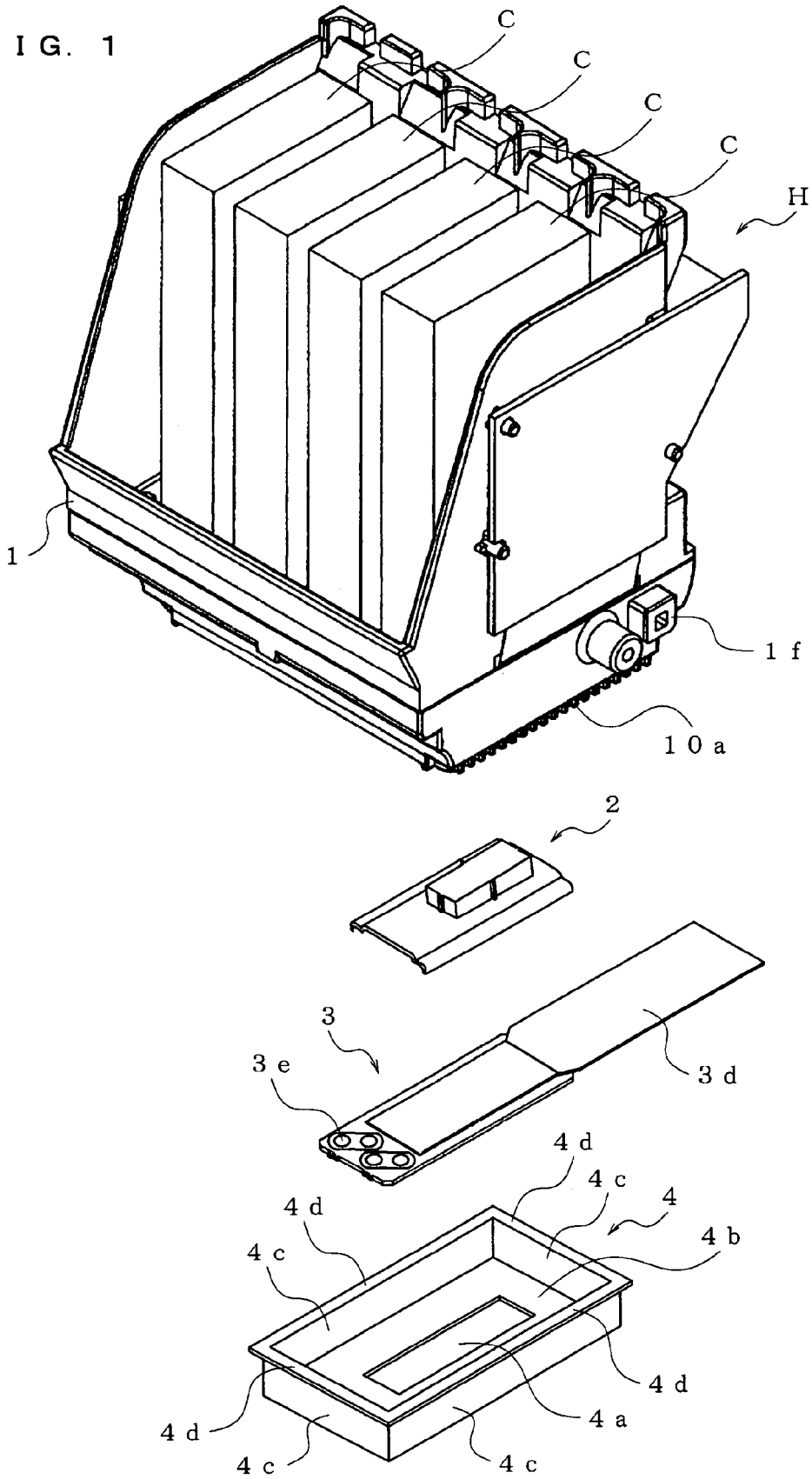
FIG. 1 is a perspective diagram showing positional relationships between parts of an inkjet printer head according to an embodiment.

The inkjet printer head H of an inkjet printer has the configuration shown in FIG. 1, where a recording head 3 and a cover plate 4 which covers the recording head 3 with nozzles of the recording head 3 exposed are placed on a lower surface 10*a* of a bottom wall 1*a* of the head holder 1 made of a synthetic resin on which respective cartridges C filled with various types of ink can be mounted, and a below described blocking member 2 is inserted between the lower surface 10*a* and the recording head 3.

Figure 2:
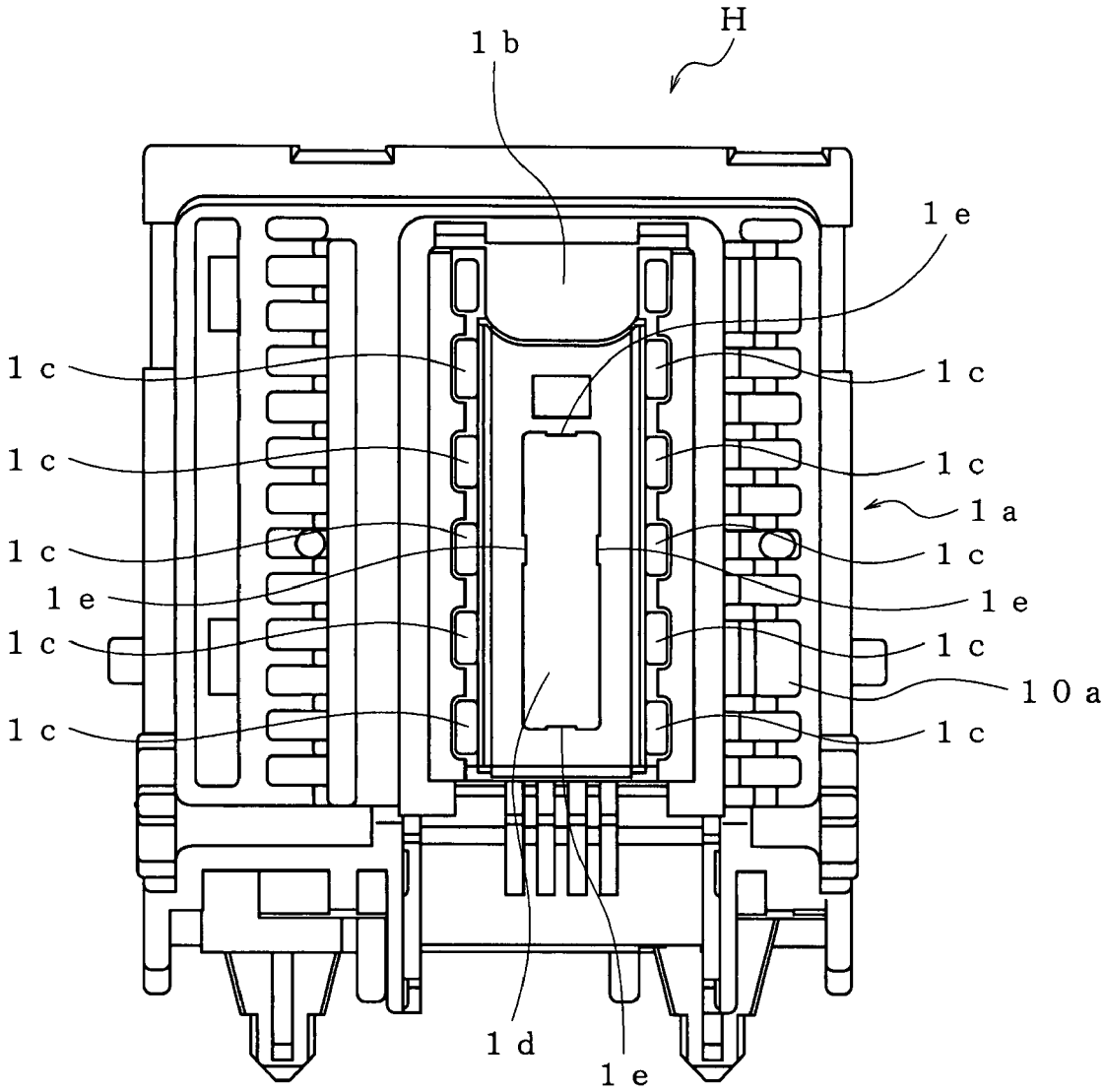
FIG. 2 is a bottom diagram showing a head holder provided in an inkjet printer head.

As shown in the bottom diagram of FIG. 2, a hole for attachment 1*b* is formed in one end portion in the bottom wall 1*a* of the head holder 1 in the depth direction of the head holder 1, which is perpendicular to the direction in which cartridges C are aligned, so that an ink flow path member (not shown) can be inserted, which connects ink supply openings 3*e* in the recording head 3 to the cartridges C. A plurality of openings 1*c* for supplying an adhesive are provided on both sides of this hole for attachment 1*b* so as to penetrate through the bottom wall 1*a* in such a state that they are aligned in two parallel columns at constant intervals in the above described depth direction.

In addition, a guide hole 1*d* in rectangular form which is long in the above described depth direction is provided between the columns of openings 1*c* so as to penetrate through the bottom wall 1*a*. Contact portions 1*e* which continue in the thickness direction of the bottom wall 1*a* and of which the cross section perpendicular to the direction in which they continue is in quadrilateral form are formed in the center portion in the width direction of each surface constituting the inner peripheral surface of the guide hole 1*d*.

Figure 3A:
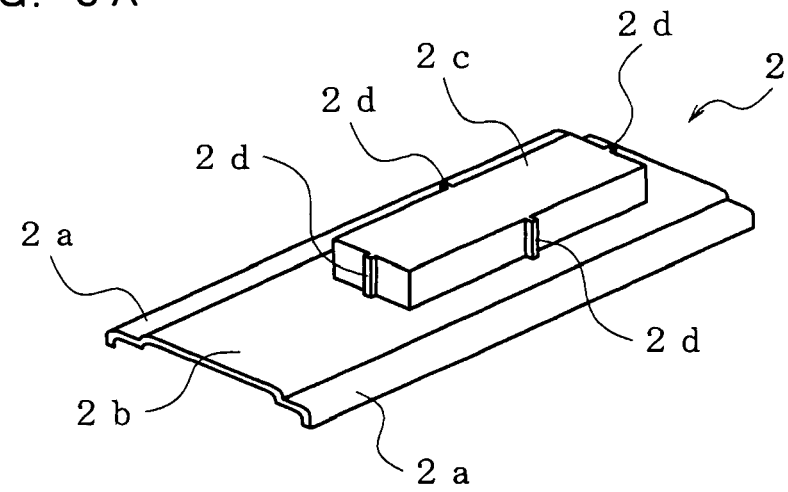
FIG. 3A is a perspective diagram showing a blocking member.

As shown in FIG. 3A, a blocking member 2 is constructed as follows. A pair of long side wall portions 2*a* having a small height are placed parallel to each other in such a manner that these side wall portions 2*a* are connected in portions where upper end portions of the side wall portions 2*a* and end portions on the long side of a ceiling wall portion 2*b* are integrated. The ceiling wall portion 2*b* is in rectangular form and the long side thereof has the same length as the side wall portions 2*a*. Both ends of the blocking member 2 in the longitudinal direction are in an open state. A guide portion 2*c* of which the form is approximately the same as or slightly smaller than the guide hole 1*d* in a plan view is provided in a location corresponding to the guide hole 1*d* so as to protrude from the upper surface of the ceiling wall portion 2*b*.

Contact portions 2*d* which continue in the height direction of the guide portion 2*c* and are formed so that the cross section in the direction perpendicular to the direction in which the contact portions 2*d* continue is in quadrilateral form are respectively provided on the outer peripheral surface of this guide portion 2*c* so as to correspond to the contact portions 1*e* around the guide hole 1*d*.

The blocking member 2 having this construction is arranged in such a state that the longitudinal direction coincides with the depth direction of the head holder 1.

Figure 3B:
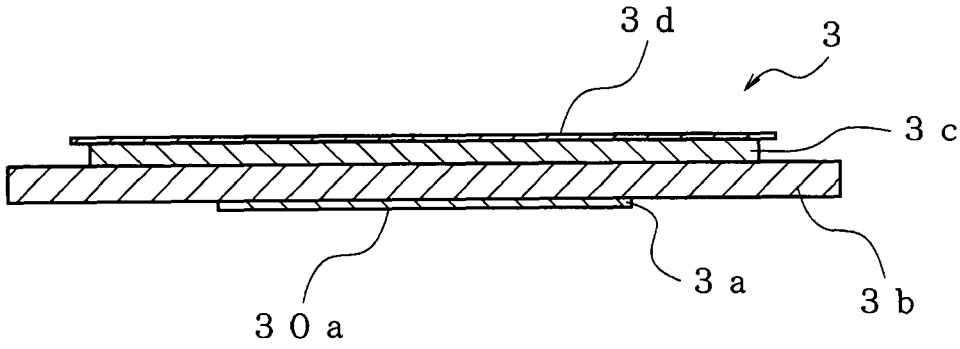
FIG. 3B is a cross sectional diagram showing a recording head provided in an inkjet printer head.

The recording head 3 is in the form of a rectangular plate. As shown in FIG. 3B, which is a cross sectional diagram of the recording head 3 in the direction perpendicular to the longitudinal direction, a cavity portion 3*b* in parallelepiped form for containing ink is secured on an upper surface of a nozzle plate 3*a* in long parallelepiped form where a number of nozzles for jetting ink are created. In addition, an actuator 3*c* in parallelepiped form for generating energy in order to jet ink is secured on an upper surface of the cavity portion 3*b*. Furthermore, a COF (chip on film) in band form is connected on an upper surface of the actuator 3*c* as a wiring member 3*d* for inputting a drive signal to the actuator 3*c*.

These respective components are layered on top of each other in such a state that the longitudinal direction coincides. The cavity portion 3*b* is wider than the nozzle plate 3*a* in the width direction perpendicular to the longitudinal direction of the recording head 3, the actuator 3*c* has a small width in comparison with the nozzle plate 3*a* and the cavity portion 3*b*, and the wiring member 3*d* is slightly wider than the actuator 3*c*. As a result, a flat surface on which side wall portions 2*a* of the blocking member 2 make contact as described below and to which an adhesive is applied is secured in two side portions on the upper surface of the cavity portion 3*b* along the long side on the outside of the actuator 3*c* in a plan view.

This recording head 3 is placed in such a state that the longitudinal direction coincides with the depth direction of the head holder 1.

The cover plate 4 has a bottom wall portion 4*b* in quadrilateral form where a hole 4*a* which is slightly greater than the nozzle plate 3*a* and smaller than the cavity portion 3*b* is formed so as to allow the entirety of the nozzle surface 30*a* on which nozzles of the nozzle plate 3*a* are provided to be exposed. Side wall portions 4*c* are provided so as to form four surrounding side surfaces for the cover plate 4, and flange portions 4*d* are formed in the upper end portions by bending the edge portions of the respective side wall portions 4*c* outward (see FIG. 1).

Figure 4:
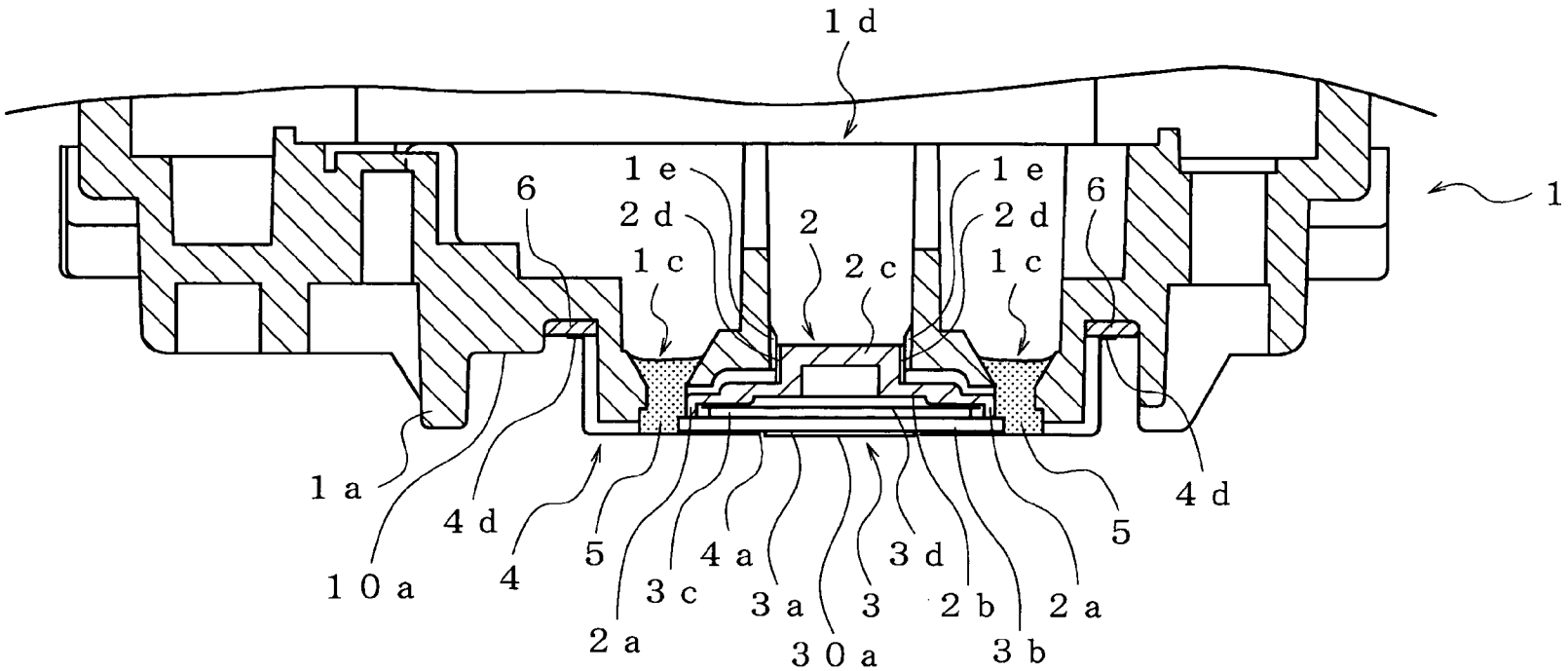
FIG. 4 is a cross sectional diagram along the line in the depth direction of an inkjet printer head.

FIG. 4 is a cross sectional diagram showing a portion of the head holder 1 in the vicinity of the center in the depth direction in the inkjet printer head H made up of these components. The recording head 3 is arranged in such a state that the wiring member 3*d* faces the lower surface 10*a* of the bottom wall 1*a* of the head holder 1. In addition, the end portions on both sides of the recording head 3 which are perpendicular to the direction in which the wiring member 3*a* faces the lower surface 10*a* of the bottom wall 1*a*, that is to say, the end portions on both sides of the cavity portion 3*b*, face openings 1*c* of the bottom wall 1*a* of the head holder 1.

In addition, the cover plate 4 is arranged on the side of the recording head 3 opposite to the actuator 3*c*, that is to say, on the surface on the nozzle plate 3*a*, with the opening side facing upward in such a state that the nozzle surface 30*a* of the nozzle plate 3*a* is exposed from the hole 4*a* and the openings 1*c* in the bottom wall 1*a* of the head holder 1 are covered from beneath.

In addition, the head holder 1, the recording head 3 and the cover plate 4 are bonded together and integrated with an ultraviolet ray curing adhesive 5 (hereinafter also referred to as UV adhesive 5) which is supplied from the openings 1*c* in the bottom wall 1*a* of the head holder 1.

The blocking member 2 is inserted between the recording head 3 and the head holder 1 which have been bonded together in this manner. The space between the inner sides and the height of the pair of side wall portions 2*a* of the blocking member 2 are set to be approximately the same as or greater than the width and the height of the actuator 3*c* and the wiring member 3*d* in the direction of the short side. The space between the outer sides of the pair of side wall portions 2*a* is set to be approximately the same as or slightly smaller than the width of the cavity portion 3*b* in the direction of the short side. The length of the pair of side wall portions 2*a* and the ceiling wall portion 2*b* in the long side is set to be approximately the same as or longer than the length of the actuator 3*c*.

Accordingly, when the blocking member 2 is placed on the recording head 3, the pair of side wall portions 2*a* respectively make contact with the end portions on both sides of the cavity portion 3*b* of the recording head 3 in such a state that the top of the actuator 3*c* and the wiring member 3*d* is covered with the ceiling wall portion 2*b*. In this state, the wiring member 3*d* is led to the outside from one open end of the blocking member 2. In addition, when the guide portion 2*c* of the blocking member 2 is engaged with the guide hole 1*d* of the head holder 1, the respective contact portions 2*d* of the guide portion 2*c* make contact with the respective corresponding contact portions 1*e* around the guide hole 1*d* in a slightly pressed and contracted state, in such a manner that the two are held at an arbitrary position in the upward and downward direction with a friction force therebetween.

This blocking member 2 prevents the UV adhesive 5 that is supplied through the openings 1*c* in the bottom wall 1*a* of the head holder 1 from making contact with the wiring member 3*d* of the recording head 3. The head holder 1, the recording head 3 and the cover plate 4 are bonded each other in such a state that the UV adhesive 5 does not make contact with the wiring member 3*d*. Here, a sealing agent 6 is provided in a gap between the flange portions 4*d* of the cove plate 4 and the lower surface 10*a* of the bottom wall 1*a* of the head holder 1 so as to prevent ink, dust and the like from entering from the outside.

Figure 5:
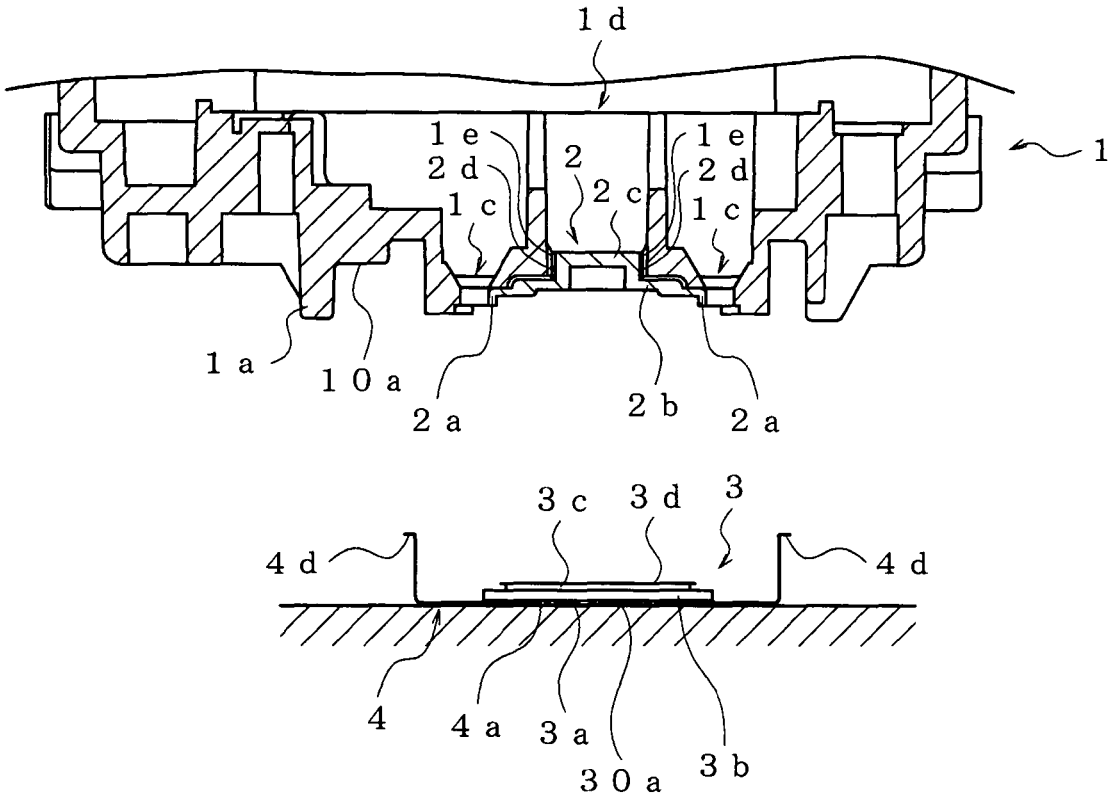
FIG. 5 is a cross sectional diagram showing a step (state where respective parts are fixed to a jig) in accordance with a manufacturing method for an inkjet printer.

Next, a method for bonding the head holder 1, the recording head 3 and the cover plate 4 together is described. The head holder 1 and the recording head 3 are secured to different jigs respectively (see FIG. 5). Here, the respective jigs are omitted in the figure. Here, only a portion of the jig for securing the recording head 3 is shown, for the sake of convenience.

The head holder 1 is secured to one jig with the lower surface 10*a* of the bottom wall 1*a* facing downward, and the guide portion 2*c* of the blocking member 2 is engaged in the guide hole 1*d* in the bottom wall 1*a* of the head holder 1 after liquid silicone is applied on the top surface of the ceiling wall portion 2*b*. Then, the upper surface of the ceiling wall portion 2*b* of the blocking member 2 is made to make contact with the lower surface 10*a* of the bottom wall 1*a* of the head holder 1, and thus, the blocking member 2 is held against the head holder 1, as a result of the surface tension of the liquid silicone. At this time, the respective contact portions 2*d* of the guide portion 2*c* make contact with the respective contact portions 1*e* around the guide hole 1*d*, so that there is a friction force between the guide portion 2*c* and the inner surface of the guide hole 1*d*, and this friction force contributes to holding the blocking member 2.

In addition, the cover plate 4 is set in the other jig with the opening side facing upward, and the recording head 3 is set on top of the bottom wall portion 4*b* of this cover plate 4 in such a manner that the nozzle plate 3*a* of the recording head 3 is engaged in the hole 4*a* of the bottom wall portion 4*b*. Then, the cover plate 4 and the recording head 3 are tightly secured to the jigs through suction of air using a vacuum apparatus (not shown) provided in the jig. Here, the sealing agent 6 is applied in advance on the lower surface 10*a* of the bottom wall 1*a* of the head holder 1 in a portion corresponding to the flange portions 4*d* of the cover plate 4.

Figure 6A:
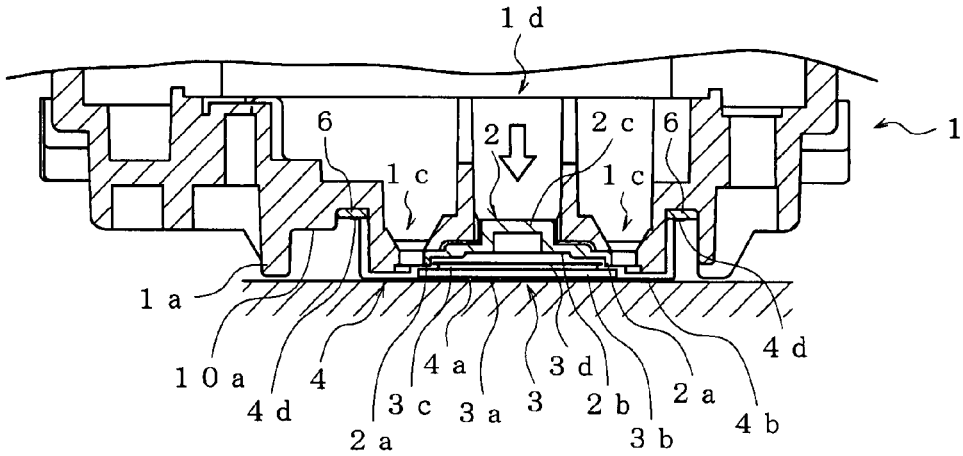
FIG. 6A is a cross sectional diagram showing a step (state where the bottom wall of the head holder and the recording head are in close proximity) in accordance with a manufacturing method for an inkjet printer.

Thus, as shown in FIG. 6A, the respective jigs are moved relatively to each other, and such a state is gained that the lower surface 10*a* of the bottom wall 1*a* of the head holder 1 and the wiring member 3*d* of the recording head 3 face each other and the columns of the openings 1*c* in the bottom wall 1*a* of the head holder 1 face the end portions on both sides of the recording head 3 along the long side. As a result, the head holder 1 and the recording head 3 are set in a predetermined relative position. The location of the positioning portion if for attaching the head holder 1 to a carriage (not shown) (FIG. 1) and the nozzles of the recording head 3, for example, is set with precision.

Figure 6B:
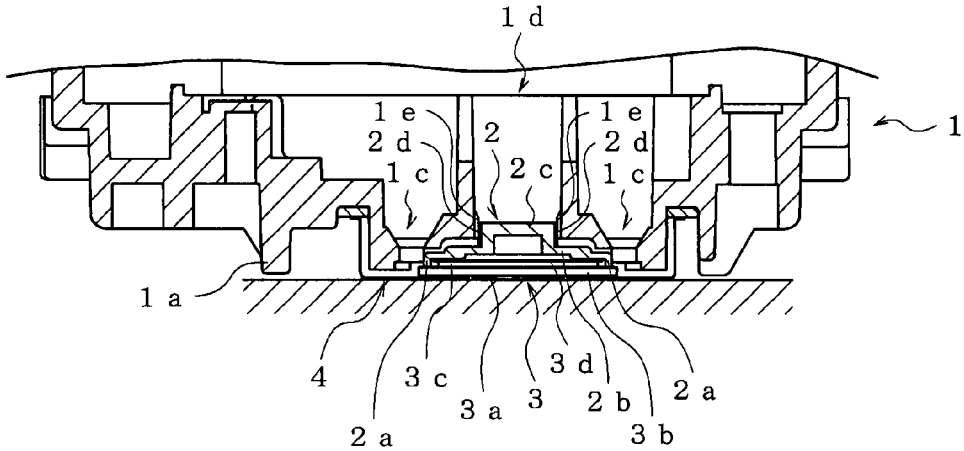
FIG. 6B is a cross sectional diagram showing a step (state where the blocking member is moved toward another jig) in accordance with a manufacturing method for an inkjet printer.

In this state, force is applied on the upper surface of the guide portion 2*c* of the blocking member 2, in the direction in which the guide portion 2*c* is pushed out of the guide hole 1*d* (direction of arrow in FIG. 6A), so that the blocking member 2 is moved toward the recording head 3, and thus, the pair of side wall portions 2*a* of the blocking member 2 are made to make contact with the cavity portion 3*b* in the end portions on both sides of the recording head 3 on the long side (FIG. 6B). The guide portion 2*c* keeps being pressed after the pair of side wall portions 2*a* of the blocking member 2 make contact with the cavity portion 3*b* in the above described manner, and thus, a state where the blocking member 2 is pressed against the recording head 3 can be maintained.

Thus, such a state is gained that the top of the wiring member 3*d* and the actuator 3*c* is covered with the ceiling wall portion 2*b* of the blocking member 2. The guide portion 2*c* of the blocking member 2 is at such a level as not to disengage completely from the guide hole 1*d*, even when the blocking member 2 is moved to the recording head 3 side, and in addition, the respective contact portions 2*d* make contact with the respective contact portions 1*e* around the guide hole 1*d*, and therefore, the position of the blocking member 2 does not change after it is moved.

Figure 6C:
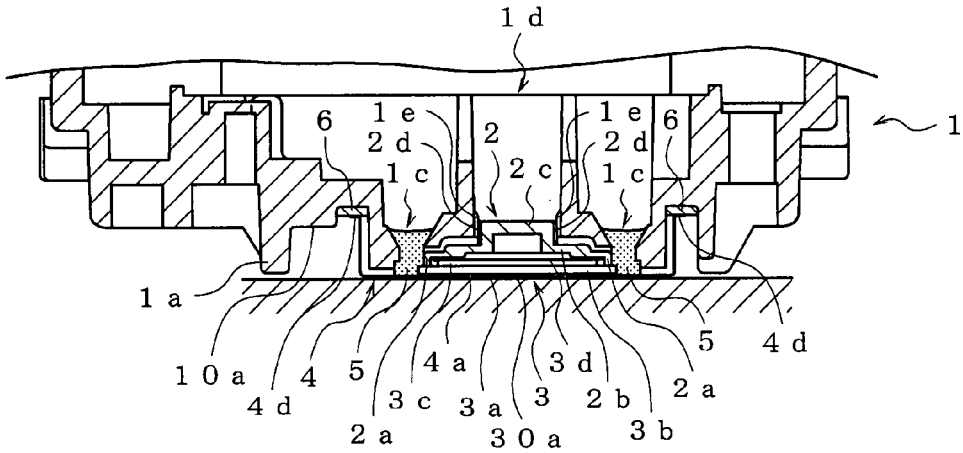
FIG. 6C is a cross sectional diagram showing a step (state where the respective parts are bonded together by supplying an ultraviolet ray curing adhesive) in accordance with a manufacturing method for an inkjet printer.

In this state, as shown in FIG. 6C, the UV adhesive 5 is supplied through the openings 1*c* in the bottom wall 1*a* of the head holder 1 until the UV adhesive 5 reaches the cover plate 4, when all of the openings 1*c* are irradiated with ultraviolet rays, so that the UV adhesive 5 is cured. At this time, the supplied UV adhesive 5 is prevented by the blocking member 2 from making contact with the wiring member 3*d* or the actuator 3*c*, and the space between the head holder 1, the end portions on both sides of the cavity portion 3*b* and the cover plate 4 is filled in with the UV adhesive 5, which is then hardened.

Reduction in the volume when this UV adhesive 5 is cured and contracts creates a force in the direction in which the pair of side wall portions 2*a* of the blocking member 2 are separated away from the cavity portion 3*b* of the recording head 3. However, a force is applied in the direction in which the blocking member 2 is pressed against the recording head 3, and therefore, this separation of the pair of side wall portions 2*a* from the cavity portion 3*b* is prevented, and the UV adhesive 5 is hardened in a state where the pair of side wall portions 2*a* and the cavity portion 3*b* make contact with each other without a space in between.

In the inkjet printer head H where the head holder 1, the recording head 3 and the cover plate 4 are bonded together and integrated in the above described manner, the UV adhesive 5 does not make contact with the wiring member 3*d*, and therefore, the UV adhesive 5 does not migrate and electrical malfunctioning, for example defective insulation, can be prevented.

In the case where the side wall portions 2*a* of the blocking member 2 are formed so as to be integrated with the bottom wall 1*a* of the head holder 1, it is necessary for the cavity portion 3*b* to make contact with the side wall portions 2*a* which are integrated with the bottom wall 1*a*, in order for the adhesive not to make contact with the actuator 3*c* and the wiring member 3*d*. However, it is difficult to form the head holder 1 of a synthetic resin by setting the positional relationship between the positioning portion if for attachment to the carriage or the like and the side wall portions 2*a* with precision, and when the position of the positioning portion if and the recording head 3 is set with precision, a space is created between the side wall portions 2*a* and the cavity portion 3*b*. In the above described embodiment, the blocking member 2 is made to make contact with the recording head 3 in a state where the relative position of the head holder 1 and the recording head 3 is set with precision, and therefore, positioning of the head holder 1 and the recording head 3 can be achieved, and the adhesive can be prevented from making contact with the actuator 3*c* and the wiring member 3*d* without failure.

Here, the space of the blocking member 2 is not limited to that in the above described embodiment, and though the pair of side wall portions 2*a* can, for example, be provided in an integrated manner, they may also be provided separately. In addition, though the blocking member 2 has such a shape that two ends are open, it can be in such a shape that the four sides of the actuator 3*c* are surrounded by the side wall portions 2*a*. Furthermore, though in the above described embodiment, contact portions 2*d* and 1*e* are provided in the guide portion 2*c* of the blocking member 2 and around the guide hole 1*d* of the head holder 1, respectively, they may be provided on only one side, and it is not necessary for the contact portion to continue around the entire circumference, and it may be provided at predetermined intervals around the circumference.

The above described inkjet printer has a structure where the recording head 3 includes the cavity portion 3*b* for containing ink and the actuator 3*c* which is secured to the cavity portion 3*b* and of which the width in the direction of the end portions on both sides is smaller than that of the cavity portion 3*b*, and the blocking member 2 includes a pair of side wall portions 2*a* which make contact with the end portions on both sides of the cavity portion 3*b* and the ceiling wall portion 2*b* which covers the top of the actuator 3*c* and the wiring member 3*d* and connects the pair of side wall portions 2*a*, and therefore, the blocking member 2 is in such a state as to stretch over the wiring member 3*d*, and thus, the pair of side wall portions 2*a* and the ceiling wall portion 2*b* of the blocking member 2 can prevent the adhesive 5 and the wiring member 3*d* from making contact with each other.

In the above described inkjet printer, the protruding guide portion 2*c* is provided on the upper surface of the ceiling wall portion 2*b* of the blocking member 2, and the guide portion 2*c* is engaged in the guide hole 1*d* which is formed in the bottom wall 1*a* of the head holder 1, and therefore, it is difficult for the blocking member 2 to shift in terms of its position, the relative position of the recording head 3 and the head holder 1 can be maintained with precision and is stable, and there is no inconsistency in terms of the location of the blocking member 2 relative to the recording head 3.

In the above described inkjet printer, a frictional force is provided between the outer surface of the guide portion 2*c* and the inner surface of the guide hole 1*d* to an extent that the blocking member 2 can be held against the bottom wall 1*a*, and therefore, there is no ricketiness when the guide portion 2*c* and the guide hole 1*d* are engaged, and thus, the blocking member 2 can be positioned with high precision. In addition, it becomes possible for the head holder 1 to hold the blocking member 2 with the frictional force in advance when the recording head 3 and the head holder 1 are made to face each other so that they can be bonded together, and thus, the efficiency of processing can be increased.

In the above described inkjet printer, a plurality of openings 1*c* for supplying the adhesive 5 to the blocking member 2 on the side opposite to the wiring member 3*b* are provided at intervals along the end portions on both sides of the recording head 3 in locations on the bottom wall 1*a* of the head holder 1 which face the end portions on both sides of the recording head 3, and therefore, the recording head 3 is bonded to the head holder 1 in a plurality of portions in these end portions on both sides, and thus, the recording head 3 and the head holder 1 can be prevented from being affected by distortion caused by reduction in the volume of the adhesive 5 when it is cured and contracts, and thus, the precision in terms of positioning of the recording head 3 and the head holder 1 during assembly is enhanced.

In the above described inkjet printer, the adhesive 5 is an ultraviolet ray curing adhesive, and therefore, the adhesive 5 can be cured quickly with any timing, and therefore, the recording head 3 and the head holder 1 can be efficiently bonded together, making the productivity high.

In the above described inkjet printer, nozzles for jetting ink are provided as openings on the surface on the side opposite to the side where the actuator 3 is located, and the cover plate 4 which is arranged so as to protrude to the outside of the end portions on both sides of the recording head 3 and has the hole 4*a* for exposing the nozzles is bonded to the recording head 3 and the head holder 1 with the adhesive 5 on the side of the surface with the openings. Accordingly, the cover plate 4 which can be attached with the adhesive 5 for bonding the recording head 3 and the head holder 1 together is provided, and therefore, the manufacturing process can be simplified, making the productivity high.

In accordance with the above described manufacturing method for an inkjet printer, a state where the blocking member 2 is pressed against the recording head 3 is maintained until the adhesive 5 is cured after the adhesive 5 is applied, and therefore, reduction in the volume of the adhesive 5 when it is cured and contracts can be prevented from separating the blocking member 2 and the recording head 3 from each other, and thus, the adhesive 5 can be prevented from making contact with the wiring member 3*d* without failure.

In accordance with the above described manufacturing method for an inkjet printer, the recording head 3 is provided with the cavity portion 3*b* for containing ink and the actuator 3*c* which is secured to the cavity portion 3*b* and of which the width in the direction of the end portions on both sides is smaller than that of the cavity portion 3*b*, and the blocking member 2 is provided with the pair of side wall portions 2*a* and the ceiling wall portion 2*b* for connecting the pair of side wall portions 2*a* in such a manner that the ceiling wall portion 2*b* covers the top of the actuator 3*c* and the wiring member 3*d* when the pair of side wall portions 2*a* of the blocking member 2 make contact with the top of the end portions on both sides of the cavity portion 3*b*. That is to say, the blocking member 2 is arranged so as to stretch over the wiring member 3*d*, and thus, contact between the adhesive 5 and the wiring member 3*d* can be prevented by the pair of side wall portions 2*a* and the ceiling wall portion 2*b*.

In accordance with the above described manufacturing method for an inkjet printer, the blocking member 2 is provided with the protruding guide portion 2*c* on the upper surface of the ceiling wall portion 2*b*, and the bottom wall 1*a* of the head holder 1 is provided with the guide hole 1*d* in which the guide portion 2*c* is to be engaged, in such a manner that the blocking member 2 can be held by the bottom wall 1*a* of the head holder 1 so as to be moveable by engaging the guide portion 2*c* in the guide hole 1*d*. When the recording head 3 and the head holder 1 are made to face each other so that they can be bonded together, the blocking member 2 is held in advance by engaging the guide portion 2*c* in the guide hole 1*d* of the head holder 1, and the blocking member 2 is moved in a such state that the recording head 3 and the head holder 1 face each other, and thus, the pair of side wall portions 2*a* of the blocking member 2 are made to make contact in the end portions on both sides of the cavity portion 3*b* in predetermined locations, and thus, the adhesive 5 is prevented from making contact with the wiring member 3*d*. Therefore, the pair of side wall portions 2*a* automatically make contact with the recording head 3 in predetermined locations, and thus, positioning becomes unnecessary and the manufacturing process can be simplified.

In accordance with the above described manufacturing method for an inkjet printer, the blocking member 2 is held against the bottom wall 1*a* of the head holder 1 as a result of the frictional force between the outer surface of the guide portion 2*c* and the inner surface of the guide hole 1*d* in such a manner as to be moveable. When the recording head 3 and the head holder 1 are made to face each other so that they can be bonded together, the blocking member 2 is held against the head holder 1 in advance as a result of frictional force and the blocking member 2 is moved against the frictional force, and thus, the pair of side wall portions 2*a* of the blocking member 2 can be made to make contact with the top of the end portions on both sides of the cavity portion 3*b* in predetermined locations with high precision. Accordingly, the blocking member 2 can be arranged on the recording head 3 with high precision.

In accordance with the above described manufacturing method for an inkjet printer, a plurality of openings 1*c* which are connected to the space of the blocking member 2 on the side opposite to the wiring member 3*d* are provided at intervals along the end portions on both sides of the recording head 3 in locations where the bottom wall 1*a* of the head holder 1 faces the end portions on both sides of the recording head 3 and the space between the end portions on both sides of the recording head 3 and the lower surface 10*a* of the bottom wall 1*a* is filled with the adhesive 5 through the openings 1*c*. Accordingly, the recording head 3 can be bonded to the head holder 1 in a plurality of locations on the end portions on both sides, and therefore, reduction in the volume of the adhesive 5 when it is cured and contracts can be prevented from causing distortion, and thus, manufacture of an inkjet printer with high precision in terms of the location of the recording head 3 and the head holder 1 during assembly becomes possible.

In accordance with the above described manufacturing method for an inkjet printer, an ultraviolet ray curing adhesive is used as the adhesive 5, and this adhesive 5 is cured by irradiating it with ultraviolet rays through the openings 1*c*. Accordingly, the adhesive 5 can be cured quickly with any timing, and therefore, the recording head 3 and the head holder 1 can be efficiently bonded together, and thus, increase in the productivity can be achieved.

In accordance with the above described manufacturing method for an inkjet printer, nozzles for jetting ink are provided on the surface as openings on the side opposite to the side where the actuator 3*c* is located, and the cover plate 4 having the hole 4*a* for exposing the nozzles is arranged so as to protrude to the outside from the end portions on both sides of the recording head on the side of the surface with the openings and bonded to the recording head and the head holder with the adhesive 5. Accordingly, the cover plate 4 is bonded at the same time as the recording head 3 and the head holder 1 are bonded together, and thus, the manufacturing process can be simplified and increase in the productivity can be achieved.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An inkjet printer, comprising:

a recording head with an actuator for generating energy in order to jet ink, where a wiring member for allowing a drive signal to be inputted to said actuator is connected to an upper surface of said actuator;

a head holder having a bottom wall for supporting said recording head;

an adhesive for bonding said recording head and said head holder together, with which a space between end portions on both sides of said recording head which are perpendicular to the direction in which said wiring member and a lower surface of said bottom wall face each other and the lower surface of said bottom wall is filled in; and a blocking member for preventing said adhesive from making contact with said wiring member which is inserted between said end portions on both sides of said recording head and said wiring member on the upper surface of said actuator as a member different from said recording head and said head holder.

2. The inkjet printer according to claim 1, wherein said recording head includes a cavity portion for containing ink and said actuator which is secured to the top of said cavity portion and of which the width in the direction of said end portions on both sides is smaller than that of said cavity portion, and said blocking member includes a pair of side wall portions which make contact with the top of said end portions on both sides of said cavity portion and a ceiling wall portion which covers the top of said actuator and said wiring member and connects said pair of side wall portions.

3. The inkjet printer according to claim 2, wherein said blocking member includes a protruding guide portion on an upper surface of said ceiling wall portion, and said guide portion is engaged in a guide hole formed in said bottom wall of said head holder.

4. The inkjet printer according to claim 3, wherein there is a frictional force for holding said blocking member on said bottom wall between the outer surface of said guide portion and the inner surface of said guide hole.

5. The inkjet printer according to claim 1, wherein a plurality of openings for supplying said adhesive to said blocking member on the side opposite to said wiring member are provided at intervals along said end portions on both sides of said recording head in locations on said bottom wall of said head holder facing said end portions on both sides of said recording head.

6. The inkjet printer according to claim 1, wherein said adhesive is an ultraviolet ray curing adhesive.

7. The inkjet printer according to claim 1, wherein said recording head has a nozzle as an opening for jetting ink on the side opposite to the side where said actuator is located, and a cover plate having a hole for exposing said nozzle is placed on the side of the surface with the opening so as to protrude to the outside from said end portions on both sides of said recording head and bonded to said recording head and said head holder with said adhesive.

8. A manufacturing method for an inkjet printer, according to which a recording head having an actuator for generating energy in order to jet ink and a wiring member for allowing a drive signal to be inputted to said actuator which is connected to an upper surface of said actuator and a head holder having a bottom wall for supporting said recording head are bonded together and secured to each other by filling a space between end portions on both sides of said recording head which are perpendicular to the direction in which said recording head and a lower surface of said bottom wall face each other and the lower surface of said bottom wall with an adhesive, comprising:

holding a blocking member having a pair of side wall portions corresponding to regions between said end portions on both sides of said recording head and said wiring member against said bottom wall of said head holder in such a manner that the blocking member can be moved in the direction in which said recording head and the lower surface of said bottom wall face each other;

arranging said head holder holding said blocking member and said recording head in such a state that the wiring member of said recording head faces the lower surface of said bottom wall;

moving said blocking member in the direction in which said pair of side wall portions make contact with said recording head in such a state that said head holder and said recording head face each other; and filling a space in said pair of side wall portions on the side opposite to said wiring member and between said end portions on both sides of said recording head and the lower surface of said bottom wall with said adhesive in such a state that said pair of side wall portions and said recording head make contact with each other, so that said head holder and said recording head are bonded together and secured to each other.

9. The manufacturing method for an inkjet printer according to claim 8, wherein the state where said blocking member is pressed against said recording head is maintained until said adhesive is cured after said adhesive is applied.

10. The manufacturing method for an inkjet printer according to claim 8, wherein said recording head comprises a cavity portion for containing ink and said actuator which is secured to the top of said cavity portion and of which the width in the direction of said end portions on both sides is smaller than that of said cavity portion, said blocking member comprises said pair of side wall portions and a ceiling wall portion for connecting said pair of side wall portions, and said ceiling wall portion covers the top of said actuator and said wiring member when said pair of side wall portions of said blocking member make contact in said end portions on both sides of said cavity portion.

11. The manufacturing method for an inkjet printer according to claim 10, wherein said blocking member comprises a protruding guide portion on an upper surface of said ceiling wall portion and said bottom wall of said head holder has a guide hole in which said guide portion is to be engaged, and said blocking member is held against said bottom wall of said head holder so as to be moveable by engaging said guide portion into said guide hole.

12. The manufacturing method for an inkjet printer according to claim 11, wherein said blocking member is held against said bottom wall of said head holder so as to be moveable as a result of frictional force between an outer surface of said guide portion and an inner surface of said guide hole.

13. The manufacturing method for an inkjet printer according to claim 8, wherein a plurarity of openings connected to a space in said blocking member on a side opposite to said wiring member are provided at intervals along said end portions on both sides of said recording head in locations on said bottom wall of said head holder facing said end portions on both sides of said recording head, and a space between said end portions on both sides of said recording head and the lower surface of said bottom wall is filled in with said adhesive through said openings.

14. The manufacturing method for an inkjet printer according to claim 13, wherein an ultraviolet ray curing adhesive is used as said adhesive, and said adhesive is irradiated with ultraviolet rays through said openings and thereby, said adhesive is cured.

15. The manufacturing method for an inkjet printer according to claim 8, wherein a nozzle for jetting ink is provided as an opening on a surface of said recording head on a side opposite to the side where said actuator is located, and a cover plate having a hole for exposing said nozzle is arranged on the side of the surface with the opening so as to protrude to the outside from said end portions on both sides of said recording head and bonded to said recording head and said head holder with said adhesive.

* * * * *